United States Patent [19]

Tenenbaum

[11] Patent Number: 4,682,493

[45] Date of Patent: Jul. 28, 1987

[54] COOLING SYSTEM MONITOR

[75] Inventor: Martin Tenenbaum, Hartsdale, N.Y.

[73] Assignee: Dakten Products Corp., Bronx, N.Y.

[21] Appl. No.: 892,894

[22] Filed: Aug. 1, 1986

Related U.S. Application Data

[63] Continuation of Ser. No. 532,368, Sep. 15, 1983, abandoned.

[51] Int. Cl.[4] ..... G01M 15/00

[52] U.S. Cl. ..... 73/118.1; 73/292

[58] Field of Search ..... 73/118.1, 440, 445, 73/32 R, 291, 323, 292; 374/145; 123/198 D

[56] References Cited

U.S. PATENT DOCUMENTS

| | | | |
|---|---|---|---|
| 1,661,269 | 3/1928 | Rorke | 374/145 X |
| 2,002,183 | 5/1935 | Lecarpentier | 73/445 |
| 2,018,403 | 10/1935 | Hussar | 73/118 |
| 3,096,748 | 7/1963 | Harry | 73/323 X |
| 3,292,427 | 12/1966 | Mattson | 73/118 |
| 3,914,994 | 10/1975 | Banner | 73/118 |
| 4,126,044 | 11/1978 | Tichy et al. | 73/440 |

*Primary Examiner*—Jerry W. Myracle

*Attorney, Agent, or Firm*—Popper, Bobis & Jackson

[57] ABSTRACT

Apparatus for monitoring the cooling system of a liquid-cooled automotive engine. The apparatus provides a warning of a malfunction within the system and diagnostic information of what the malfunction is. The compact apparatus is easily mounted in the inlet radiator hose and includes elements for measuring the coolant level, flow rate, pressure and temperature.

7 Claims, 3 Drawing Figures

COOLING SYSTEM MONITOR

This application is a continuation of application Ser. No. 532,368, filed 9-15-83, now abandoned.

The present invention provides a relatively inexpensive device that can be easily installed on a liquid-cooled internal combustion engine, such as an automobile engine. Once installed, the device permits safe monitoring of the operation of the cooling system and provides information enabling prevention or diagnosis of many common problems.

Early automobiles having liquid-cooled engines had a thermometer on the dashboard to indicate the temperature of the coolant. These expensive remote-indicating thermometers have been replaced by "idiot lights" in recent model cars. An idiot light is illuminated upon high temperature of the coolant. While the thermometer and idiot lights both warn of high coolant temperature, neither provide further information as to what is causing the high temperature. Moreover they alert the driver at a time when it may be too late to readily and safely remedy the problem. Removing the radiator cap to determine whether low liquid level is causing the high temperature can result in a dangerous spewing of hot coolant.

The present invention provides a device that gives the mechanic or driver more information than was possible with prior art systems without performing the dangerous step of opening the radiator cap. The present invention comprises:

Apparatus for monitoring the cooling system of a liquid-cooled internal combustion engine having a radiator and a conduit in fluid communication with an upper section of the radiator, said apparatus comprising:

(a) a housing adapted to be permanently mounted on the conduit at the same level as the upper section of the radiator such that liquid may flow through said housing;

(b) means for indicating the level of liquid within said housing thereby providing an indication of the level of liquid within the upper section of the radiator, and (c) means for indicating the specific gravity of liquid within said housing.

DETAILED DESCRIPTION OF THE INVENTION

Figure 1:
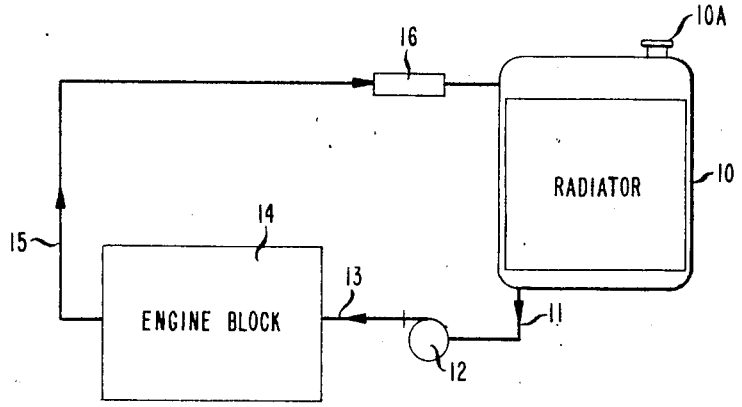
FIG. 1 is a schematic view of an engine cooling system showing the preferred location for installing the device of the present invention.

The cooling system in FIG. 1 comprises a radiator 10, conduit 11, pump 12, conduit 13, engine block 14 and conduit 15. Hot liquid from engine Block 14, flows into radiator 10 via conduit 15, which is typically a radiator hose. The liquid, having been cooled in radiator 10, flows back to engine block 14 via conduits 11 and 13, with pump 12 providing the energy necessary to drive the liquid through the engine block.

For reasons that will become apparant, the device of the present invention, represented by numeral 16, is mounted on inlet hose 15 near the top of radiator 10.

Figure 2:
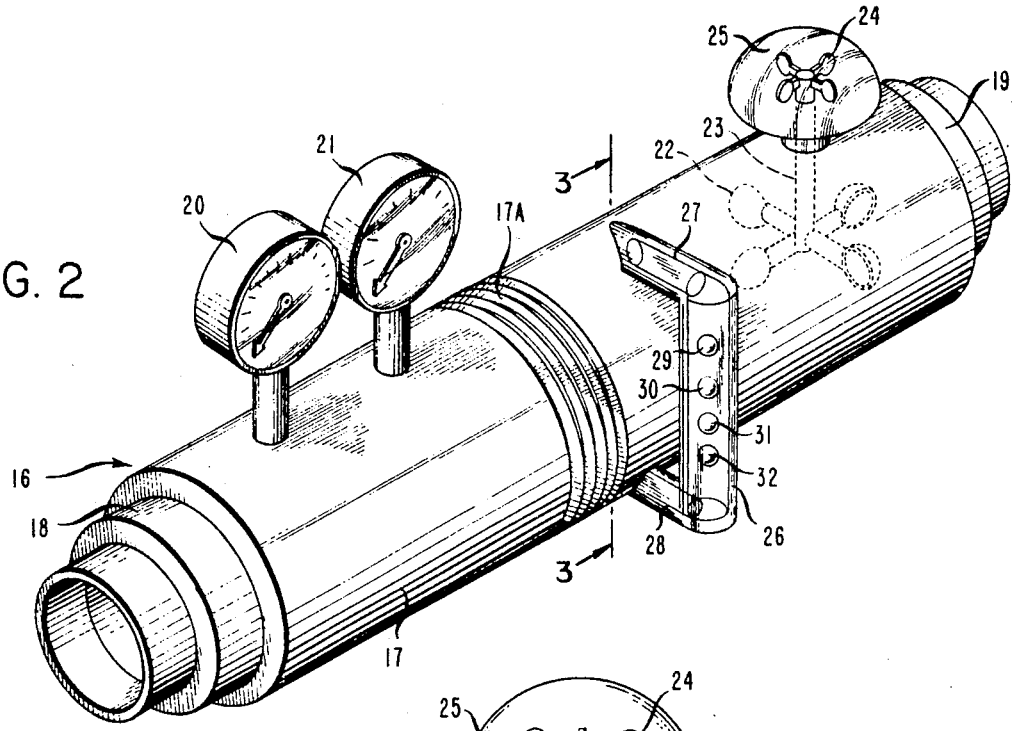
FIG. 2 is an isometric view of a cooling system monitor in accordance with the invention.
Figure 3:
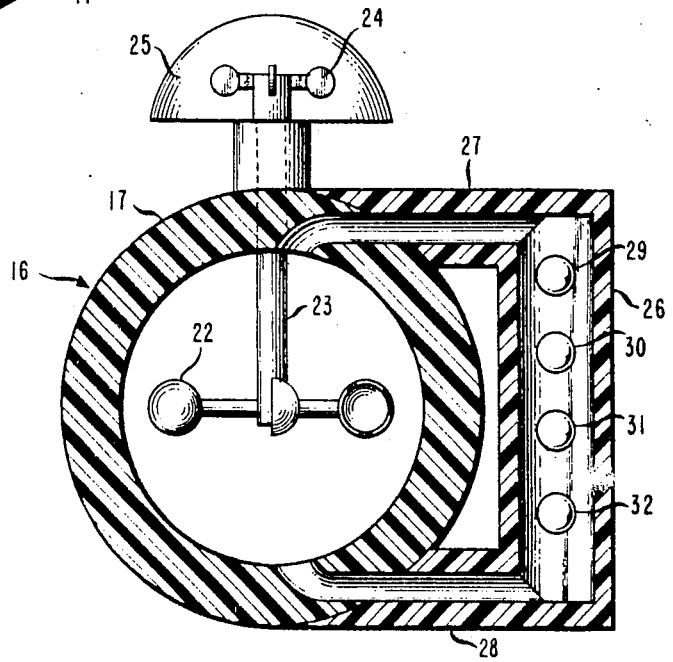
FIG. 3 is a sectional view taken along line 3—3 of FIG. 2.

The preferred embodiment of the cooling system monitor is shown in FIGS. 2 and 3. Cooling system monitor 16 has a hollow housing 17 adapted to be mounted in radiator hose 15 so that coolant may flow through the housing. Preferably housing 17 has "stepped" ends 18 and 19, adapted to fit hoses of various sizes. The hose (not shown in FIGS. 2 and 3) is slipped over the circular step of the appropriate size on each end of housing 16 and secured with a hose clamp (not shown), well known in the art. Housing 17 may have a flexible section 17A to facilitate installation.

The device has means for indicating the level and specific gravity of liquid within the housing. This may be accomplished by means of a transparent sight glass 26 mounted with its top and bottom in fluid communication with housing 17 via conduits 27 and 28. An indication of specific gravity of the coolant is accomplished by having 2 or more balls 29, 30, 31, 32 of varying specific gravity trapped within sight glass 26. Balls 29 to 32 are arranged in order of decreasing specific gravity from the bottom to the top of sight glass 26. That is the ball having the highest specific gravity is on the bottom. The more balls that float the higher the specific gravity of liquid in the sight glass and the higher the amount of anti-freeze in the coolant solution.

The level and specific gravity of the coolant are its two most important properties. Prior to the present invention, it was necessary to remove the radiator cap (Item 10A of FIG. 1) to measure them. Yet removing this cap when the system is under pressure can be dangerous and wasteful of the antifreeze that may spew out when the cap is removed.

Housing 17 provides a convenient opportunity for installing means for measuring other properties of the coolant. A thermometer 20 and pressure gauge 21 may be mounted on housing 17 to indicate the temperature and pressure respectively of the coolant within the housing.

For clarity, thermometer 20 and pressure gauge 21 are shown with their dials mounted vertically. In practice it is preferable to mount these instruments with their dials parallel to housing 17, or even built into the housing to keep the apparatus compact.

The monitor may also have a means for indicating whether liquid is flowing within the housing. These means can comprise a simple rotor 22 adapted to be spun by flowing liquid. Rotor 22 is attached by shaft 23 to spinner 24 mounted externally to housing 17 within transparant casing 25. Motion of spinner 24 indicates that coolant is flowing through housing 17.

Once installed as shown in FIG. 1, the coolant system monitor operates as follows. Under normal circumstances, after the engine has been running long enough to be warmed up, thermometer 20 and pressure gauge 21 will indicate the temperature and pressure at which the coolant is designed to operate. Spinner 24 will be spinning. Sight glass 26 will be full, and all 4 specific gravity balls 29–32 will be floating.

Deviations from normal can be spotted during routine stops at gas stations while the mechanic is checking other conditions under the hood. The nature of the deviation will give a very good indication of what is causing the trouble, i.e. the device of the present invention is a very good diagnostic tool.

For example, if thermometer 20 reads too high and spinner 24 is not spinning, that indicates that the cooling system thermostat (not shown in FIG. 1) is not opening up on high temperature as it is supposed to.

If thermometer 20 reads too low and spinner 24 is spinning, then the thermostat is not closing upon low temperature as it should.

If pressure gauge 21 reads too low, it indicates that there is a leak in the system. If sight glass 26 is full, then the leak is probably in the radiator cap, item 10A of FIG. 1. If sight glass 26 is not full, then the leak is located some place lower than the radiator cap.

If not all specific gravity balls 29–31 are floating, the coolant mixture is too dilute i.e. not enough anti-freeze is present in the system.

When it is necessary to open radiator cap 10A, a quick glance at pressure gauge 21 will show the mechanic whether it is safe to remove the cap. If the pressure is substantially above atmospheric, he will know that he must allow the system to cool or bleed off the pressure in the system before opening the cap.

Although the monitor of the present invention is designed to provide a low-cost system that can be easily seen by opening the hood of the automobile, it is apparent that one or more of the instruments may be adapted via known circuitry to provide a reading on the dashboard. Such remote-reading instruments would be particularly useful on high-performance engines where trouble is likely to occur, such as those of racing cars, boats, planes, motorcycles, etc.

It can be seen that the present invention provides a monitor for cooling systems that provides a warning of trouble much earlier than the simple thermometer of the prior art. Furthermore the monitor not only warns of trouble, it can provide very good diagnostic information about what the trouble is. Moreover, the monitor makes it much safer for the mechanic who must remove the radiator cap.

What is claimed is:

1. Apparatus for monitoring the cooling system of a liquid-cooled internal combustion engine having a radiator and a conduit in fluid communication with an upper section of the radiator, said apparatus comprising:

(a) a housing adapted to be connected in line with the conduit at the same level as the upper section of the radiator such that liquid may flow through said housing;

(b) means for indicating the level of liquid within said radiator, said means including a short, substantially vertically oriented, transparent by-pass conduit connected at opposite ends thereof in fluid communication with said housing and at the same level as the upper section of the radiator when said housing is connected in line with said conduit, to provide a visual indication of the level of liquid within the upper section of the radiator;

(c) means for indicating the rate of flow of said liquid in said housing;

(d) means for indicating the pressure of said liquid in said housing; and (e) means for indicating the temperature of said liquid in said housing.

2. The apparatus of claim 1 further comprising at least one additional means mounted on said housing for indicating another property of the liquid within said housing.

3. The apparatus of claim 2 wherein said at least one additional means includes specific gravity indicating means having at least two floatation articles with different specific gravities positioned within said by-pass conduit.

4. The apparatus of claim 1 wherein said means for indicating the pressure is a pressure gauge.

5. The apparatus of claim 1 wherein said means for indicating the temperature is a thermometer.

6. The apparatus of claim 1, wherein said housing is positioned in a substantially horizontal arrangement when connected in line with said conduit at the same level as the upper section of the radiator.

7. Apparatus for monitoring the cooling system of a liquid-cooled internal combustion engine having a radiator and a conduit in fluid communication with an upper section of the radiator, said apparatus comprising:

(a) a housing adapted to be connected in line with the conduit at the same level as the upper section of the radiator such that liquid may flow through said housing;

(b) means for providing a visual indication of the level of liquid within the upper section of the radiator;

(c) means for indicating the rate of flow of said liquid in said housing;

(d) means for indicating the pressure of said liquid in said housing; and (e) means for indicating the temperature of said liquid in said housing.

* * * * *